US011885106B2

(12) United States Patent
Shobu et al.

(10) Patent No.: US 11,885,106 B2
(45) Date of Patent: Jan. 30, 2024

(54) WORKING MACHINE

(71) Applicant: KUBOTA CORPORATION, Osaka (JP)

(72) Inventors: Kazuaki Shobu, Sakai (JP); Hiroshi Horii, Sakai (JP); Hitoshi Iwamura, Sakai (JP); Shoichi Kawano, Sakai (JP); Shohei Doi, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 241 days.

(21) Appl. No.: 17/538,073

(22) Filed: Nov. 30, 2021

(65) Prior Publication Data

US 2022/0090361 A1 Mar. 24, 2022

Related U.S. Application Data

(63) Continuation of application No. PCT/JP2020/021365, filed on May 29, 2020.

(30) Foreign Application Priority Data

Jun. 4, 2019 (JP) ..... 2019-104520

(51) Int. Cl.
*E02F 9/22* (2006.01)

(52) U.S. Cl.
CPC ..... *E02F 9/2275* (2013.01); *E02F 9/2271* (2013.01)

(58) Field of Classification Search
CPC ..... E02F 9/2232; E02F 9/2275
(Continued)

(56) References Cited

U.S. PATENT DOCUMENTS 6,684,537 B2 * 2/2004 Ichikawa ..... E02F 3/32 37/466
9,181,679 B2 * 11/2015 Matsumoto ..... B62D 55/06
10,590,895 B2 * 3/2020 Matsumiya ..... F02M 37/0047

FOREIGN PATENT DOCUMENTS

EP 2 653 620 A1 10/2013
EP 2 725 150 A1 4/2014
(Continued)

OTHER PUBLICATIONS

International Search Report for PCT/JP2020/021365 dated Aug. 18, 2020.
(Continued)

*Primary Examiner* — Todd M Epps
(74) *Attorney, Agent, or Firm* — BIRCH, STEWART, KOLASCH & BIRCH, LLP

(57) ABSTRACT

A working machine includes: a support bracket provided on a machine body and including a boom pivotal support portion and a cylinder pivotal support portion; a boom pivotally supported by the boom pivotal support portion; a boom cylinder pivotally supported at the cylinder pivotal support portion and the boom, and causing the boom to swing upward and downward; a hydraulic hose extended through the support bracket from the rear of the support bracket to the front of the support bracket and connected to the boom cylinder; a first clamp to retain the hydraulic hose on the support bracket; and a second clamp to retain the hydraulic hose on the boom cylinder. The support bracket includes a through hole through which the hydraulic hose is passed in a fore-and-aft direction. The first clamp is disposed rearward of the through hole and forward of the rear end of the boom shaft.

7 Claims, 9 Drawing Sheets

(58) Field of Classification Search
USPC ..... 37/347, 466; 248/637, 646
See application file for complete search history.

(56) References Cited

FOREIGN PATENT DOCUMENTS

| | | | |
|---|---|---|---|
| EP | 2 789 750 | A1 | 10/2014 |
| JP | 2001-32316 | A | 2/2001 |
| JP | 4004041 | B2 | 11/2007 |
| JP | 2008-202238 | A | 9/2008 |
| JP | 4790657 | B2 | 10/2011 |
| JP | 2016-75042 | A | 5/2016 |
| JP | 2016-188548 | A | 11/2016 |
| JP | 2017-66788 | A | 4/2017 |
| WO | WO 2009/110272 | A1 | 9/2009 |

OTHER PUBLICATIONS

Written Opinion of the International Searching Authority for PCT/JP2020/021365 dated Aug. 18, 2020.
Extended European Search Report for European Application No. 20819542.0, dated May 9, 2023.

* cited by examiner

WORKING MACHINE

CROSS REFERENCE TO RELATED APPLICATIONS

This application is a continuation application of International Application No. PCT/JP2020/021365, filed on May 29, 2020, which claims the benefit of priority to Japanese Patent Application No. 2019-104520, filed on Jun. 4, 2019. The entire contents of each of these applications are hereby incorporated herein by reference.

BACKGROUND OF THE INVENTION

1. Field of the Invention

The present invention relates to a working machine such as a backhoe.

2. Description of the Related Art

A working machine disclosed in Japanese Patent Publication No. 4004041 is already known.

The working machine disclosed in Japanese Patent Publication No. 4004041 includes a support bracket disposed to a front portion of a machine body. The support bracket includes a boom pivotal support portion disposed to an upper portion thereof and a cylinder pivotal support portion disposed to a lower front portion thereof. The boom pivotal support portion pivotally supports a boom. The cylinder pivotal support portion pivotally supports, via a cylinder shaft, a cylinder tube of a boon cylinder for driving the boom. A piston rod of the boom cylinder is pivotally supported and connected to an intermediate portion of the boom. When the boom cylinder is extended or contracted, the boom swings up and down, and the boom cylinder also swings up and down. A hydraulic hose connected to the boom cylinder is arranged through the support bracket, extending forward from a portion rearward of the support bracket. The support bracket includes a through hole for passing the hydraulic hose therethrough beside the cylinder pivotal support portion. A clamp, which holds the hydraulic hose in the support bracket, is disposed behind and near a cylinder shaft.

SUMMARY OF THE INVENTION

Additionally, a clamp for holding the hydraulic hose is disposed on the boom cylinder side. The hydraulic hose is flexed (loosened) when the boom is swung up and down from a dead point position at which the cylinder shaft, the clamp on the support bracket side, and the clamp on the cylinder side are aligned in a straight line.

In the conventional working machine, the clamp on the support bracket side is located in the vicinity of the cylinder shaft. Accordingly, in order to prepare an extra length of the hydraulic hose for the flexing, the clamp on the cylinder side has to be located to separate from the cylinder shaft. Thus, when the boom is swung upward from the dead point position, the hydraulic hose will be flexed so that the hydraulic hose protrudes forward of the boom cylinder. Also, when the boom is swung downward from the dead point position, the hydraulic hoses will be flexed so that the hydraulic hose protrudes upward of the boom cylinder.

When the hydraulic hose protrudes forward of the boom cylinder, the bucket may hit the hydraulic hose during an excavating operation, and accordingly the hydraulic hose may be damaged. Also, when the hydraulic hose protrudes upward of the boom cylinder, the hydraulic hose may hit the boom, and accordingly the hydraulic hose may be damaged.

Accordingly, in view of the above problems, the present invention intends to provide a working machine capable of preventing a hydraulic hose from being flexed when a boom is swung up and down.

A working machine according to an aspect of the present invention, includes a machine body, a support bracket provided on a front portion of the machine body, the support bracket including a boom pivotal support portion at an upper portion thereof, and a cylinder pivotal support portion at a front lower portion thereof, a boom pivotally supported by the boom pivotal support portion via a boom shaft, a boom cylinder pivotally supported at one end portion thereof by the cylinder pivotal support portion and at the other end portion thereof by the boom, a telescopic action of the boom cylinder causing the boom to swing upward and downward, a hydraulic hose extended through the support bracket from the rear of the support bracket to the front of the support bracket and connected to the boom cylinder, a first clamp to retain the hydraulic hose on the support bracket, and a second clamp to retain the hydraulic hose on the boom cylinder. The support bracket includes a through hole through which the hydraulic hose is passed in a fore-and-aft direction. The first clamp is disposed rearward of the through hole and forward of a rear end of the boom shaft.

Also, the boom cylinder includes a cylinder tube pivotally supported by the cylinder pivotal support portion, and a piston rod capable of protruding and withdrawing from and into the cylinder tube, the piston rod being pivotally connected to the boom. The second clamp is attached to the cylinder tube. The hydraulic hose moves within a width of the cylinder tube in a swingable range of the boom cylinder.

Also, the through hole has proximal and distal ends in the machine body and the first clamp is disposed rearward of the proximal end of the through hole. The clamp is slanted forwardly in a distal direction in the machine body and forwardly upward.

Also, the working machine includes a cylinder shaft via which the boom cylinder is pivotally supported by the cylinder pivotal support portion. The first clamp is disposed at a position lower than an upper end of the cylinder shaft and closer to a lower end of the through hole than a vertically middle portion of the through hole.

Also, the working machine further includes a clamp bracket via which the first clamp is attached to the support bracket. The support bracket includes a sidewall including the boom support portion. The clamp bracket is attached to an inside portion of the sidewall by a fastener provided onto the sidewall from the outside of the sidewall.

Also, the sidewall includes a first sidewall and a second sidewall opposed to each other with a space therebetween, and a front wall connecting front portions of the first and second sidewalls to each other. The cylinder pivotal support portion is provided on the front wall. The through hole is formed in the front wall beside the cylinder pivotal support portion. The first clamp is disposed on the inside portion of at least one of the first and second sidewalls.

Also, the working machine includes a hose guide attached to the support bracket to guide the hydraulic hose. The hose guide includes a first regulation portion disposed forward of the through hole and on a distal side of the hydraulic hose in the machine body, and a second regulation portion extended from a lower end of the first regulation portion in a proximal direction in the machine body so as to be located below the hydraulic hose.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

DETAILED DESCRIPTION OF THE PREFERRED EMBODIMENTS

Figure 1:
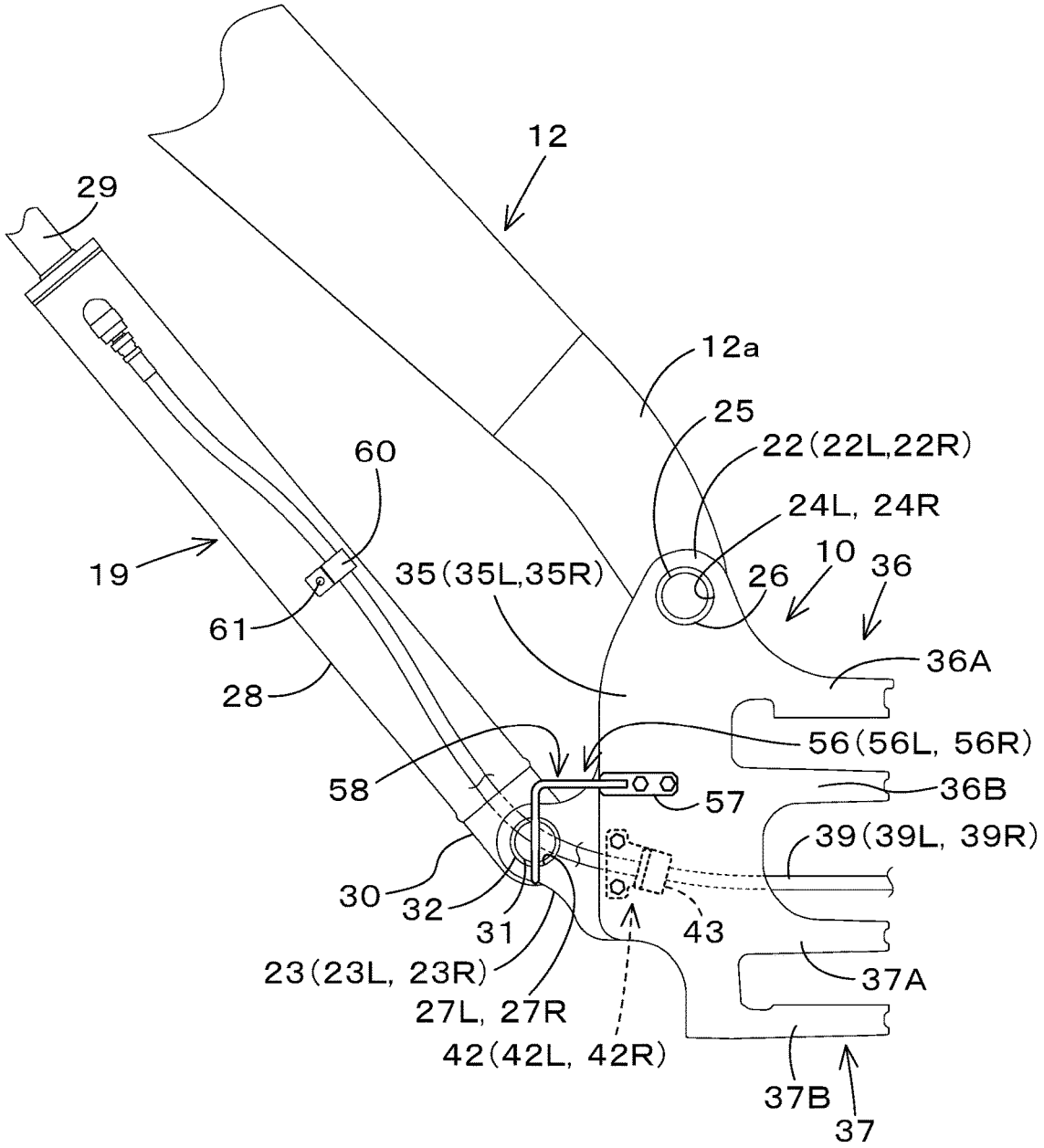
FIG. 1 is a side view of a part of a front working device.

The preferred embodiments will now be described with reference to the accompanying drawings, wherein like reference numerals designate corresponding or identical elements throughout the various drawings. The drawings are to be viewed in an orientation in which the reference numerals are viewed correctly.

Referring to the drawings as appropriate, an embodiment of the present invention will be described below.

Figure 9:
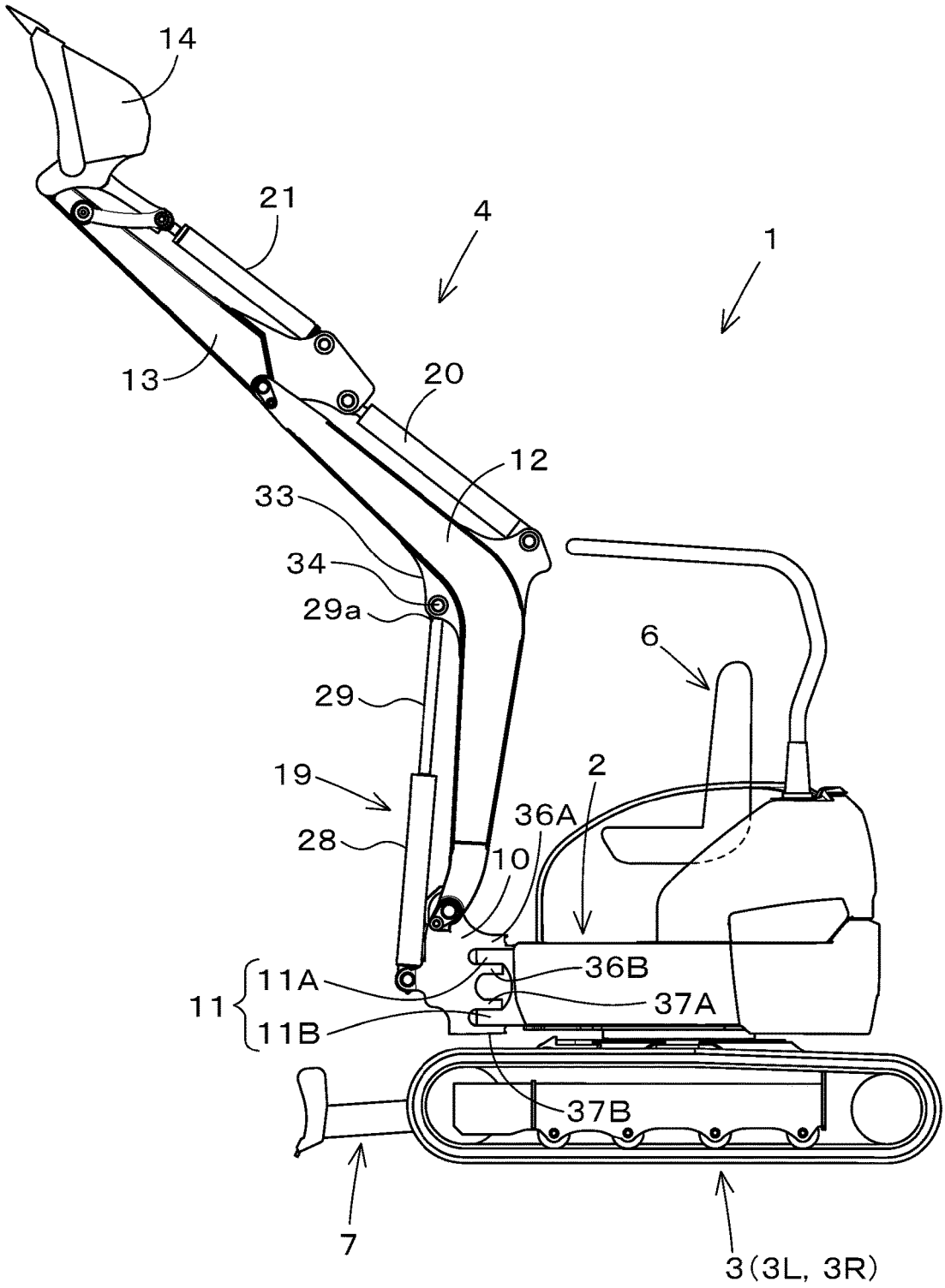
FIG. 9 is a schematic side view of a working machine.

FIG. 9 is a schematic side view showing an overall configuration of a working machine 1 according to the embodiment. In the embodiment, a backhoe, that is a swiveling working machine, is exemplified as the working machine 1.

As shown in FIG. 9, the working machine 1 includes a machine body (swiveling platform) 2, traveling devices 3, and a front working device 4. On the machine body 2, an operator's seat (seat) 6 on which a driver (operator) is seated is mounted.

In explanation of this embodiment, a forward direction from the operator seated in the operator's seat 6 of the working machine 1 (a direction of an arrowed line A1 in FIG. 9) is referred to as the front, a backward direction from the operator (a direction of an arrowed line A2 in FIG. 9) is referred to as the rear, a leftward direction from the operator (a direction of a front surface side in FIG. 9) is referred to as the left, and a rightward direction from the operator (a direction of a back surface side in FIG. 9) is referred to as the right. Also, a horizontal direction, which is a direction orthogonal to a fore-and-aft direction (longitudinal direction in machine body) K1 shown in FIG. 9, is described as a machine width direction (width direction in the machine body 2). Also, a direction from a center portion of the machine body 2 to the right or left in the width direction is described as a distal direction of the machine body. A direction opposite to the distal direction of the machine body is described as a proximal direction in the machine body.

As shown in FIG. 9, the traveling devices 3 are crawler-type traveling devices including a first crawler traveling body 3L disposed on one side (left portion) of the machine body 2 in the width direction and a second crawler traveling body 3R disposed on the other side (right portion) of the machine body 2 in the width direction. The traveling devices 3 support the machine body 2 so that the machine body 2 can travel. Also, the machine body 2 is supported on the traveling device 3 so that the machine body 2 can be swiveled around a vertical axis (an axis extending in the vertical direction). A dozer device 7 is attached to front portions of the traveling devices 3.

As shown in FIG. 9, the front working device 4 is disposed forward of the machine body 2. The front working device 4 is supported by a swing bracket (support bracket) 10 disposed on a front portion of the machine body 2. The swing bracket 10 is rotatably supported around the vertical axis by a pivotal support bracket 11 protruding forward from the machine body 2. The front working device 4 includes a boom 12 supported swingably up and down on the swing bracket 10, an arm 13 supported swingably on a tip end portion of the boom 12, and a working tool (bucket) 14 supported swingably on a tip end portion of the arm 13.

Also, the front working device 4 includes a boom cylinder 19 configured to drive the boom 12, an arm cylinder 20 configured to drive the arm 13, and a working tool cylinder 21 configured to drive the working tool 14. Each of the boom cylinder 19, arm cylinder 20, and working tool cylinder 21 is constituted of a double-acting hydraulic cylinder.

As shown in FIGS. 1 to 5, the swing bracket 10 includes a boom pivotal support portion 22 disposed at an upper portion thereof and a cylinder pivotal support portion 23 disposed at a front lower portion thereof.

Figure 3:
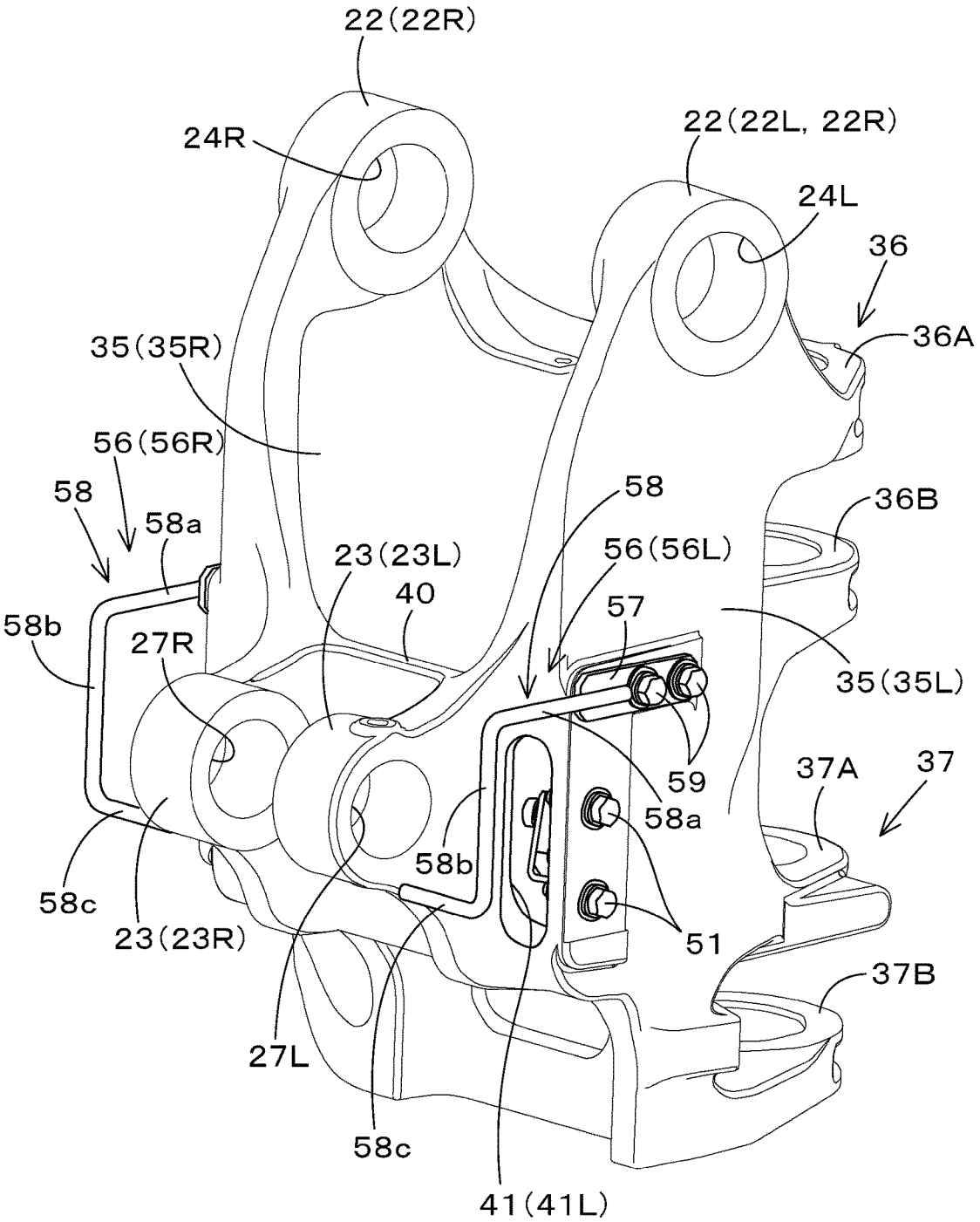
FIG. 3 is a perspective view of the swing bracket.

As shown in FIG. 3, the boom pivotal support portion 22 includes a first pivotal support portion 22L and a second pivotal support portion 22R juxtaposed with a clearance therebetween in the machine width direction. The first pivotal support portion 22L is disposed leftward of the second pivotal support portion 22R with a clearance therebetween. A shaft support hole 24L is formed in the first pivotal support portion 22L. A shaft support hole 24R is formed in the second pivotal support portion 22R. As shown in FIG. 1, a base portion 12*a* of the boom 12 is inserted between the first and second pivotal support portions 22L and 22R. A boom shaft 25 is inserted through the shaft support hole 24L, the shaft support hole 24R, and the base portion 12*a* of the boom 12 via a bushing 26. The boom shaft 25 has an axis extending in the horizontal direction (horizontal axis), and the boom 12 can swing up and down around the boom shaft 25 (around the horizontal axis).

As shown in FIG. 3, the cylinder pivotal support portion 23 includes a first pivotal support portion 23L and a second pivotal support portion 23R, which are juxtaposed with a clearance therebetween in the machine width direction. The first pivotal support portion 23L is disposed leftward of the second pivotal support portion 23R. A shaft support hole 27L is formed in the first pivotal support portion 23L. A shaft support hole 27R is formed in the second pivotal support portion 23R. As shown in FIG. 1, one end portion of the boom cylinder 19 is inserted between the first pivotal support portion 23L and the second pivotal support portion 23R. In detail, the boom cylinder 19 includes a cylinder tube 28 and a piston rod 29 configured to be protruded and withdrawn from and into the cylinder tube 28. A connecting portion 30 on a bottom portion of the cylinder tube 28 is inserted between the first pivotal support portion 23L and the second pivotal support portion 23R. A cylinder shaft 31 having a horizontal axis is inserted through the shaft support hole 27L, the shaft support hole 27R, and the connecting portion 30 via a bushing 32. Accordingly, the cylinder tube 28 is pivotally supported by the cylinder pivotal support portion 23 rotatably around the cylinder shaft 31 (around the horizontal axis).

As shown in FIG. 9, a tip end portion 29*a* of the piston rod 29 is pivotally connected to a stay 33 rotatably around the horizontal axis via a cylinder pin 34, the stay 33 being fixed on a lower surface of an intermediate portion of the boom 12.

The boom cylinder 19 is extended by protruding the piston rod 29 from the cylinder tube 28, and is contracted by withdrawing the piston rod 29 into the cylinder tube 28. When the boom cylinder 19 is extended, the boom 12 swings upward, and when the boom cylinder 19 is contracted, the boom 12 swings downward. The boom cylinder 19 swings up and down around the cylinder shaft 31 together with the boom 12.

As shown in FIG. 3, the swing bracket 10 includes a sidewall 35 that includes the boom pivotal support portion 22. In detail, the sidewall 35 includes a first sidewall 35L including the first pivotal support portion 22L and a second sidewall 35R including the second pivotal support portion 22R. The first sidewall 35L is located leftward of the second sidewall 35R and is opposed to the second sidewall 35R with a clearance therebetween.

Figure 2:
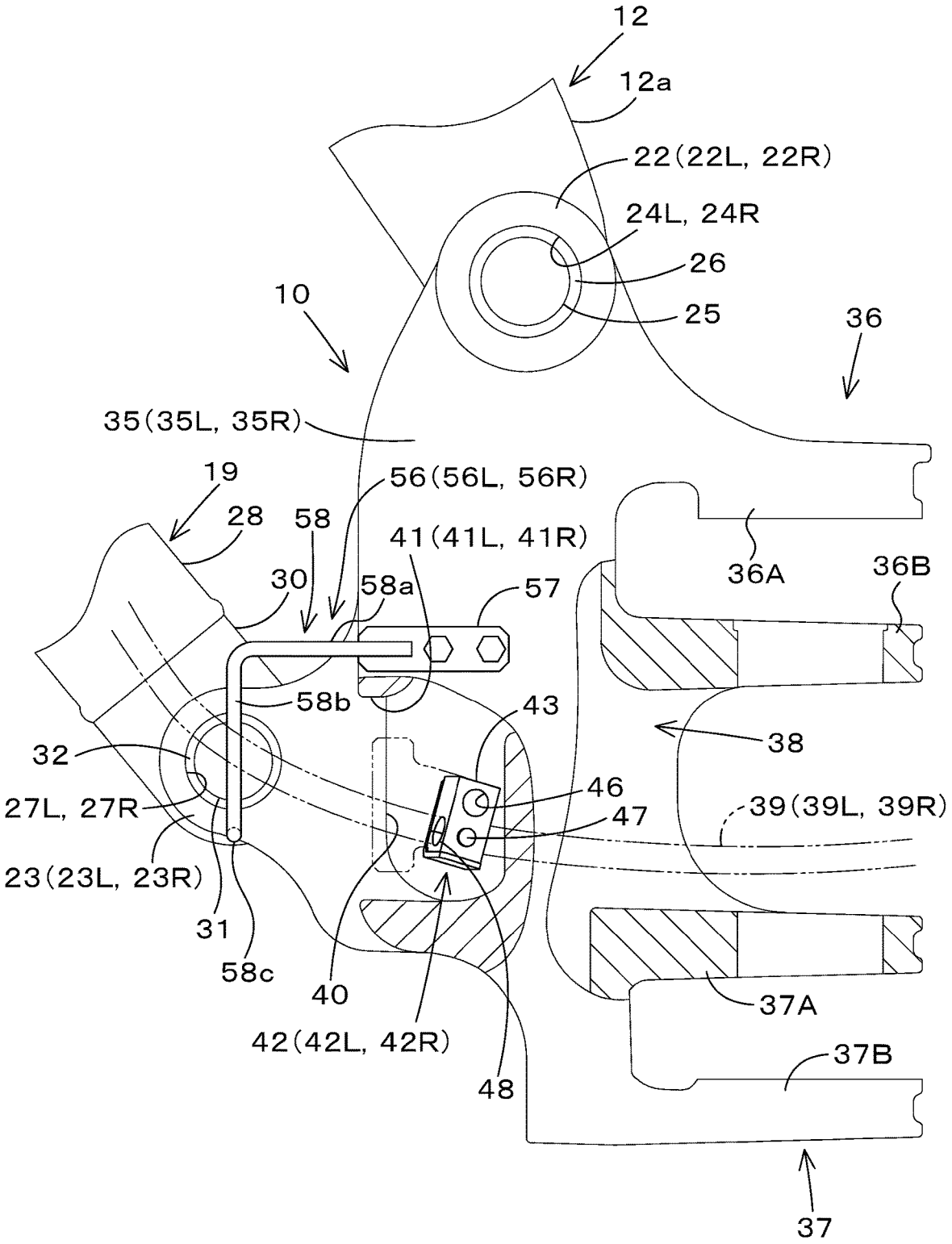
FIG. 2 is a partial cross-sectional side view of a swing bracket.

As shown in FIGS. 1 and 2, the swing bracket 10 has a rear portion including an upper pivotal support base portion 36 and a lower pivotal support base portion 37. The upper pivotal support base portion 36 and lower pivotal support base portion 37 are disposed between the first sidewall 35L and the second sidewall 35R. The upper pivotal support base portion 36 includes an upper wall portion 36A and a lower wall portion 36B located below the upper wall portion 36A with a clearance therebetween. As shown in FIG. 9, an upper wall portion 11A of the pivotal support bracket 11 is inserted between the upper wall portion 36A and the lower wall portion 36B. The upper pivotal support base portion 36 is pivotably connected to the upper wall portion 11A of the pivotal support bracket 11 by a pin swingably around the vertical axis.

As shown in FIGS. 1 and 2, the lower pivotal support base portion 37 includes an upper wall portion 37A and a lower wall portion 37B disposed below the upper wall portion 37A with a clearance therebetween. As shown in FIG. 9, a lower wall 11B of the pivotal support bracket 11 is inserted between the upper wall portion 37A and the lower wall portion 37B. The lower pivotal support base portion 37 is pivotably connected to the lower wall portion 11B of the pivotal support bracket 11 by a pin swingably around the vertical axis.

Figure 6:
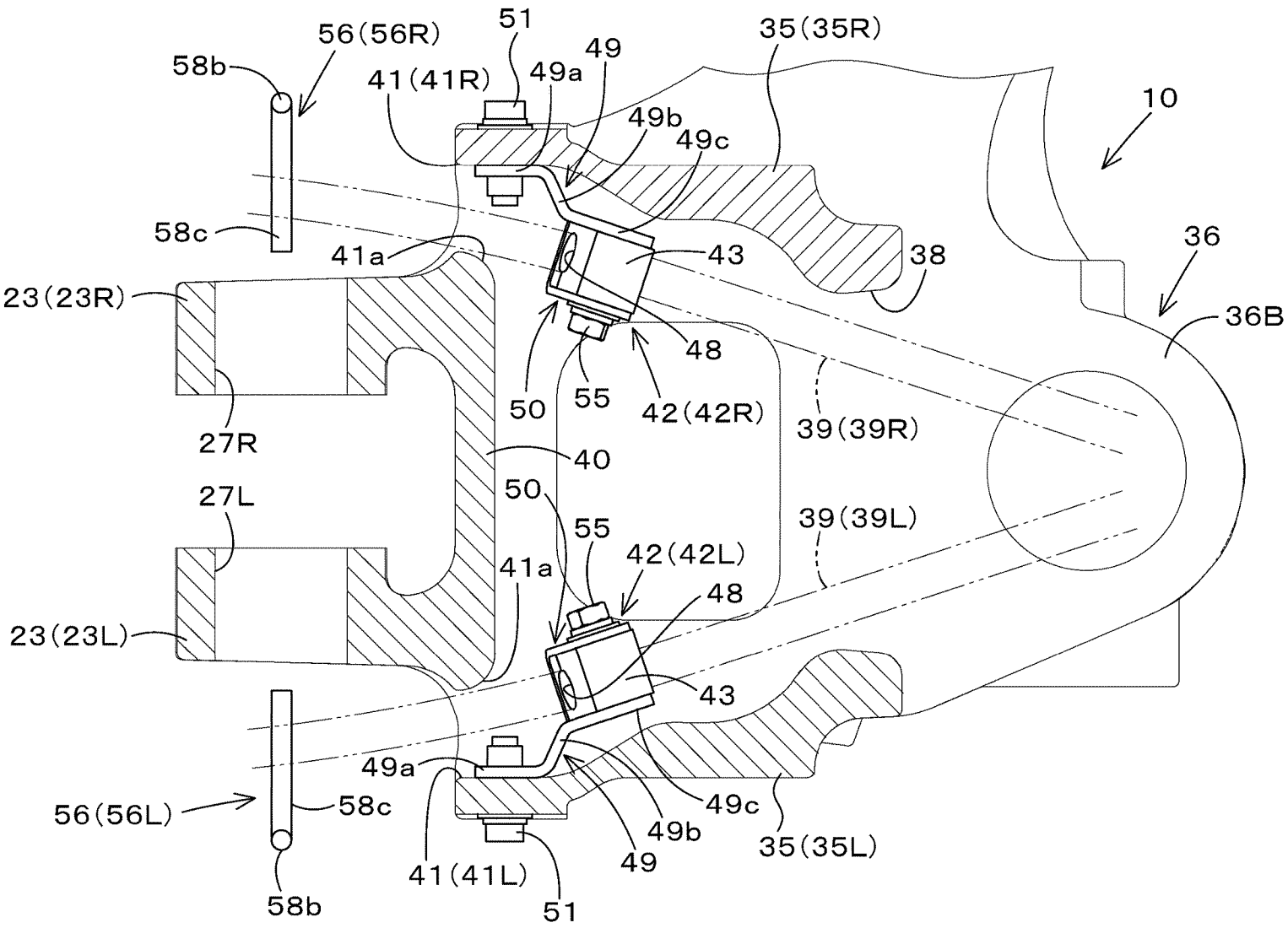
FIG. 6 is a partial cross-sectional plan view of the swing bracket.

As shown in FIGS. 2 and 6, the swing bracket 10 has a rear portion including an opening 38 between the lower wall portion 36B of the upper pivotal support base portion 36 and the upper wall portion 37A of the lower pivotal support base portion 37. A control valve that controls the boom cylinder 19 is disposed on the machine body 2 side, and a hydraulic hose 39 that is connected to the boom cylinder 19 is inserted into the swing bracket 10 (between the first and second sidewalls 35L and 35R) through the opening 38 from the machine body 2 side. The hydraulic hose 39 includes a first hose 39L that is connected to a head side of the cylinder tube 28 (a side from which the piston rod 29 protrudes) and a second hose 39R that is connected to a bottom side of the cylinder tube 28.

Figure 4:
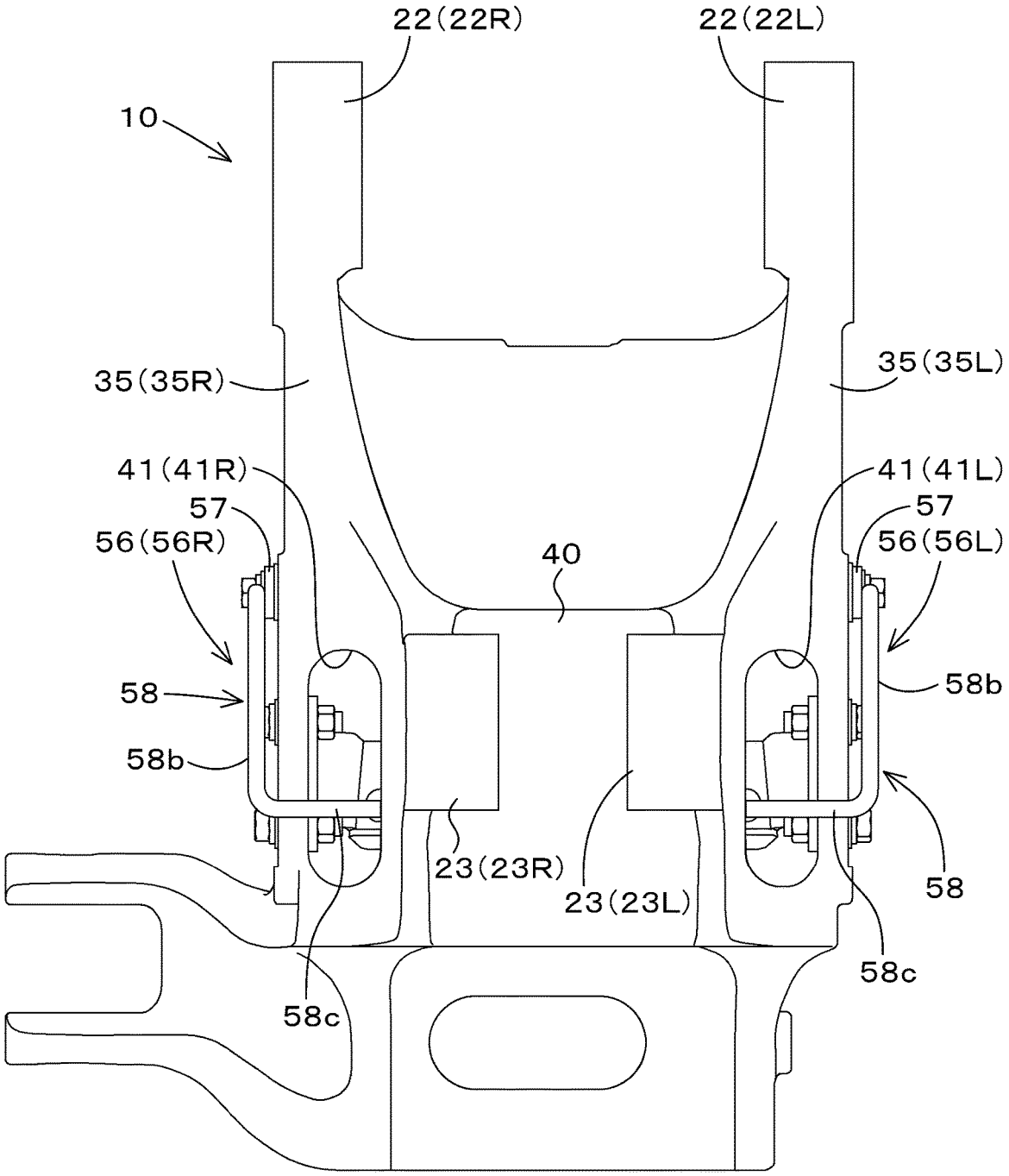
FIG. 4 is a front view of the swing bracket.

As shown in FIGS. 3 and 4, the swing bracket 10 includes a front wall 40 connecting lower front portions of the first sidewall 35L and the second sidewall 35R to each other. The front portions of the first and second sidewalls 35L and 35R have thicknesses such that they are formed thicker from the boom pivotal support portion 22 to the front wall 40, and the front portions of the first and second sidewalls 35L and 35R are connected to the front wall 40.

As shown in FIGS. 2 to 4 and FIG. 6, the cylinder pivotal support portion 23 is integrally formed on the front wall 40 to protrude forward. The front wall 40 (swing bracket 10) includes a through hole 41 through which the hydraulic hose 39 is passed in the fore-and-aft direction K1, the through hole 41 being located beside the cylinder pivotal support portion 23. In detail, the through hole 41 include a first through hole 41L formed leftward of the first pivotal support portion 23L of the cylinder pivotal support portion 23 and a second through hole 41R formed rightward of the second pivotal support portion 23R of the cylinder pivotal support portion 23. The first hose 39L is passed through the first through hole 41L to be arranged leftward of the cylinder tube 28. The second hose 39R is passed through the second through hole 41R to be arranged rightward of the cylinder tube 28.

As shown in FIG. 6, a clamp structure 42 is disposed in the swing bracket 10 to retain the hydraulic hoses 39 on the swing bracket 10. In detail, the clamp structure 42 includes a first clamp structure 42L that retains the first hose 39L and a second clamp structure 42R that retains the second hose 39R. The clamp structure 42 is disposed rearward of the through hole 41. In detail, the first clamp structure 42L is disposed rearward of the first through hole 41L, and the second clamp structure 42R is disposed rearward of the second through hole 41R.

Figure 7:
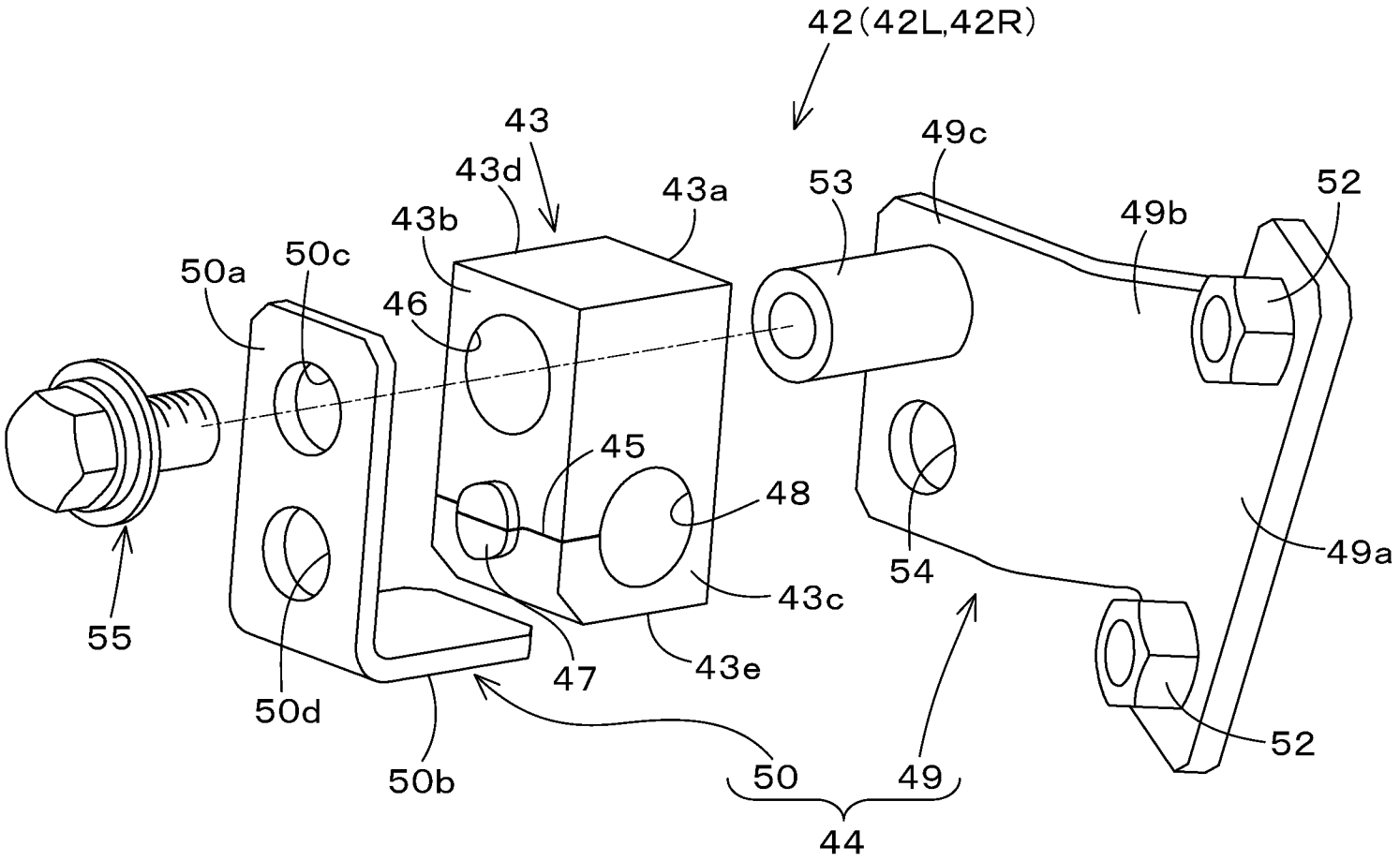
FIG. 7 is an exploded perspective view of a clamp an a clamp bracket.

As shown in FIG. 7, the clamp structure 42 includes a first clamp 43 that retains the hydraulic hose 39 on the swing bracket 10 and a clamp bracket 44 that attaches the first clamp 43 to the swing bracket 10. The first clamp 43 is formed of a rubber block body.

As shown in FIG. 2, the first clamp 43 is disposed rearward of the through hole 41. In detail, as shown in FIG. 6, the first clamp 43 is disposed rearward of a proximal end portion 41*a* of the through hole 41 in the machine body. Also, as shown in FIG. 2, the first clamp 43 is disposed forward of a rear end of the boom shaft 25. In detail, the first clamp 43 is disposed forward of the center of the boom shaft 25. A rear end portion of the first clamp 43 is located rearward of a front end of the boom shaft 25.

As shown in FIGS. 2 and 6, the first clamp 43 faces forwardly slantwise in a machine-distal direction and forwardly upward slantwise. Also, as shown in FIG. 2, the first clamp 43 is located downward of an upper end of the cylinder shaft 31 and closer to a lower end portion of the through hole 41 than to a vertical middle portion of the through hole 41.

As shown in FIG. 7, the first clamp 43 includes a through hole 46, protruding portions 47, an insertion hole 48, and a slit 45. The through hole 46 is formed in an upper portion of the first clamp 43 and extends through the first clamp 43 between a first side surface 43*a* of the first clamp 43 on the machine-distal side of the first clamp 43 and a second side surface 43*b* of the first clamp 43 on a machine-proximal side of the first clamp 43. Each of the protruding portions 47 is formed in a columnar shape, and is provided on a lower portion of each of the first side surface 43*a* and the second side surface 43*b*. The insertion hole 48 is formed through the first clamp 43 between a front surface 43*c* of the first clamp 43 and a rear surface 43*d* of the first clamp 43. The hydraulic hose 39 is inserted through the insertion hole 48. In detail, the first hose 39L is inserted through the insertion hole 48 of the first clamp structure 42L, and the second hose 39R is inserted through the insertion hole 48 of the second clamp structure 42R. The slit 45 is formed in the first clamp 43 to extend in the machine-proximal direction from the insertion hole 48 and throughout from the front surface 43*c* to the rear surface 43*d* so as to divide the protruding portion 47 into upper and lower halves. Accordingly, by widening the slit 45, the hydraulic hose 39 can be inserted into the insertion hole 48.

As shown in FIG. 7, the clamp bracket 44 includes an attached member 49 and a retaining member 50. As shown in FIG. 6, the attached member 49 includes an attached portion 49*a* that is attached to a front portion of the sidewall 35 with bolts (fasteners) 51, an extending portion 49*b* extending in an inclining direction that shifts backwardly from the attaching portion 49*a* in the proximal direction in the machine body, and a support portion 49*c* extending backwardly slantwise in the machine-proximal direction from a rear end of the extending portion 49*b*. As shown in FIG. 7, the attached portion 49*a* is formed in a vertically-long plate shape, and nuts 52 are fixed to upper and lower portions of a machine-proximal side surface of the attached portion 49*a*. The bolts 51 are screwed into the respective nuts 52 through the corresponding sidewall 35 from the machine-distal side of the swing bracket 10. Accordingly, the clamp bracket 44 is attached to an inside portion of the sidewall 35 by the bolts 51 inserted from the outside of the sidewall 35. In detail, the clamp bracket 44 of the first clamp structure 42L is attached to an inner surface of the first sidewall 35L, and the clamp bracket 44 of the second clamp structure 42R is attached to an inner surface of the second sidewall 35R. Note that the nuts 52 do not have to be fixed to the attached portion 49*a*.

A nut member 53 is fixedly formed on an upper portion of the support portion 49*c* so as to protrude in the machine-proximal direction from the support portion 49*c*. The nut member 53 is formed in a cylindrical shape. The nut member 53 is inserted through the through hole 46 of the first clamp 43. A fitting hole 54 is formed in a lower portion of the support portion 49*c* so that the protruding portion 47 formed on the first side surface 43*a* is fitted into the fitting hole 54.

As shown in FIG. 7, the retaining member 50 includes a first wall 50*a* in contact with the second side surface 43*b* of the first clamp 43 and a second wall 50*b* in contact with a lower surface 43*e* of the first clamp 43, thereby being formed in an L-shape. The first wall 50*a* includes an upper portion that includes a bolt insertion hole 50*c* and a lower portion that includes a fitting hole 50*d* into which the protruding portion 47 formed on the second side surface 43*b* is fitted. By a bolt 55 inserted through the bolt insertion hole 50*c* and screwed into the nut member 53, the first clamp 43 is retained in the clamp bracket 44.

The clamp structure 42 sub-assembled with the hydraulic hoses 39 can be attached to the swing bracket 10 from the outside, thereby achieving easy assembly. Also, even when the clamp structure 42 is inside the swing bracket 10, the bolts 51 can be removed from the outside, thereby achieving easy maintenance.

Figure 5:
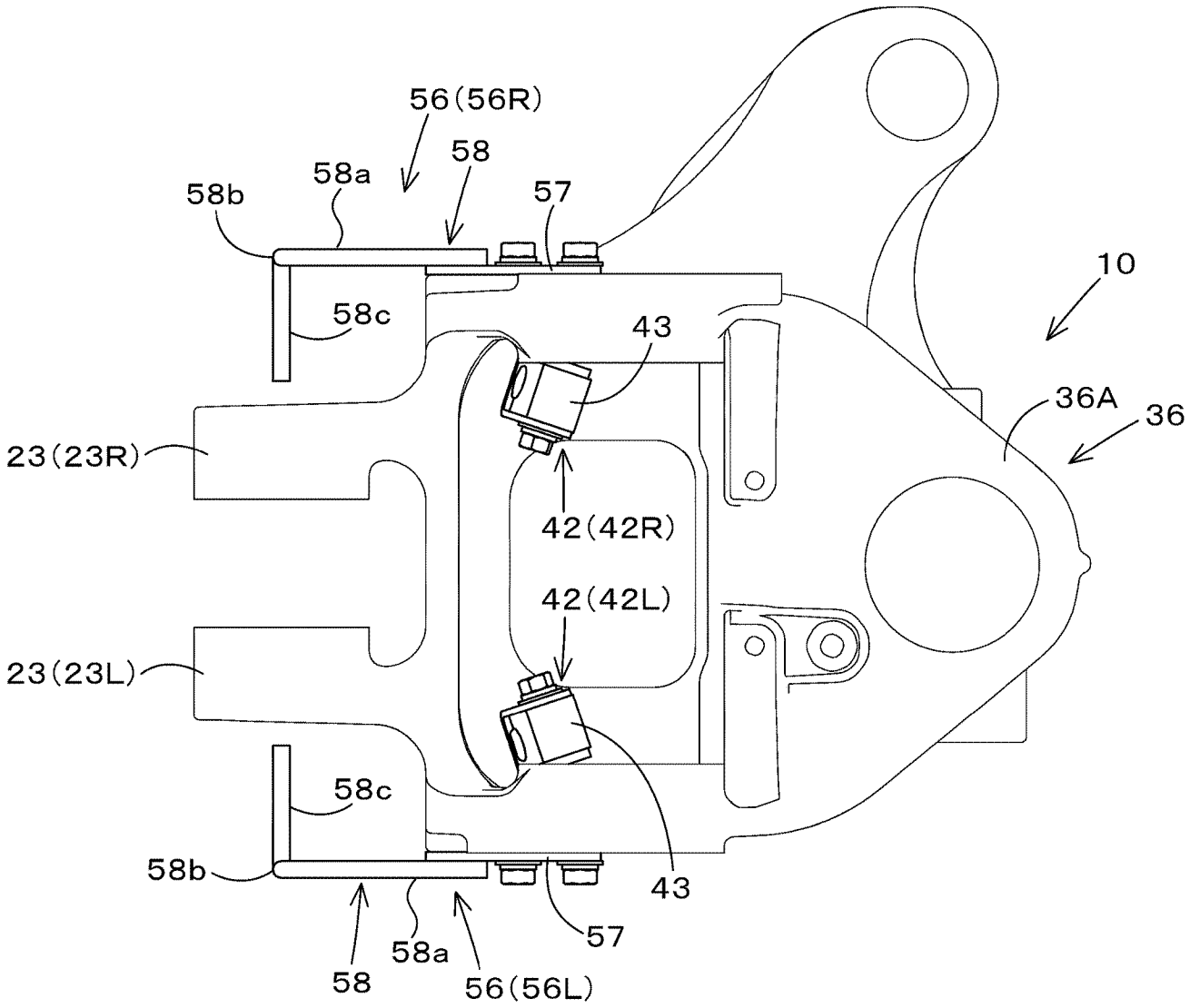
FIG. 5 is a plan view of the swing bracket.

As shown in FIG. 2, the swing bracket 10 includes a hose guide 56 to guide the hydraulic hose 39. In detail, as shown in FIGS. 4 and 5, the hose guide 56 includes a first hose guide 56L that is attached to the first sidewall 35L and a second hose guide 56R that is attached to the second sidewall 35R. The hose guide 56 includes an attachment plate 57 and a guide rod 58. The attachment plate 57 is formed of a longitudinally-long plate-shaped member and is attached to an outer surface of the sidewall 35 above the clamp structure 42 by bolts 59. The attachment plate 57 of the first hose guide 56L is attached to an outer surface of the first sidewall 35L, and the attachment plate 57 of the second hose guide 56R is attached to an outer surface of the second sidewall 35R.

As shown in FIG. 3, the guide rod 58 includes a support rod portion 58*a*, a first regulation portion 58*b*, and a second regulation portion 58*c*. The support rod portion 58*a* is fixed a rear portion thereof to a front portion of the attachment plate 57, and protrudes forward from the attachment plate 57.

As shown in FIG. 2, the first regulation portion 58*b* extends downward from a front end of the support rod portion 58*a*. The first regulation portion 58*b* is located beside the cylinder shaft 31. In detail, the first regulation portion 58*b* overlaps with the cylinder shaft 31 in a side view when the swing bracket 10 faces forward of the machine body 2. As shown in FIG. 6, the first regulation portion 58*b* is located forward of the through hole 41 and on the machine-distal side of the hydraulic hose 39.

As shown in FIGS. 3 and 4, the second regulation portion 58*c* extends in the machine-proximal direction from a lower end of the first regulation portion 58*b*. As shown in FIG. 2, the second regulation portion 58*c* is disposed below the hydraulic hose 39.

As shown in FIG. 1, a second clamp 60 that retains the first hose 39L (hydraulic hose 39) on the boom cylinder 19 is attached to the boom cylinder 19. The second clamp 60 is attached, with a screw 61, to a substantially longitudinal center portion of the cylinder tube 28 in the longitudinal direction thereof. The second clamp 60 is a kind of member that restricts the movement of the hydraulic hose 39 in the longitudinal direction thereof. The second clamp 60 may be a kind of guide that restricts the angle of the hydraulic hose 39. The second hydraulic hose 39 is connected to the clamp or piping member at approximately the same position as the first hose 39L.

Figure 8:
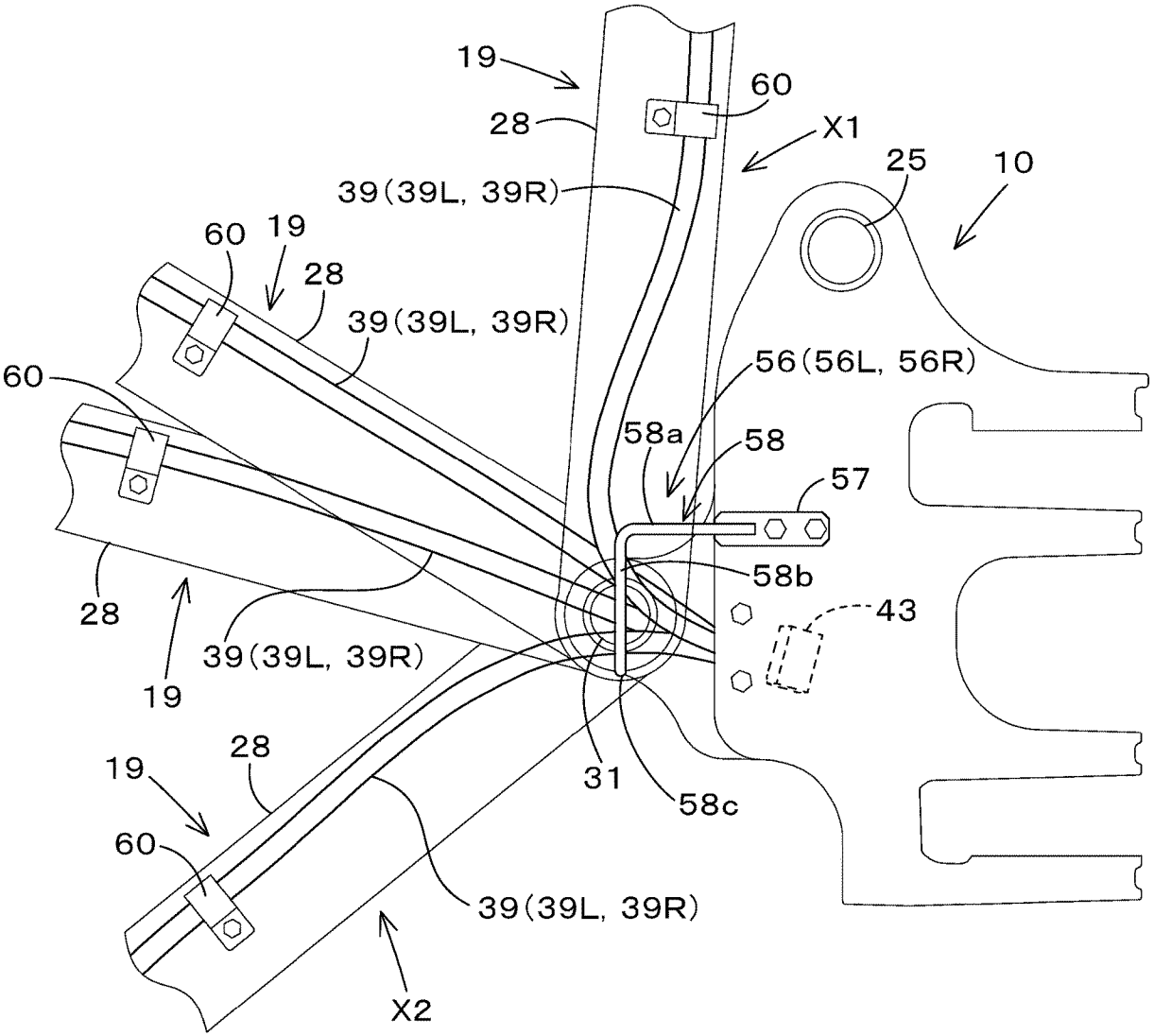
FIG. 8 is a side view showing movement of a boom cylinder.

FIG. 8 shows the movement of the hydraulic hose 39 caused when the boom cylinder 19 is extended or contracted. The hydraulic hose 39 flexes when the boom 12 is swung up and down from the dead point position where the cylinder shaft 31, the first clamp 43 and the second clamp 60 are aligned in a straight line. In detail, when the boom 12 is swung upward from the dead point position, the hydraulic hose 39 flexes to protrude forward. Also, when the boom 12 is swung upward from the dead point position, the hydraulic hose 39 flexes to protrude upward. In this embodiment, the first clamp 43 is located rearward of the through hole 41 and forward of the rear end of the boom shaft 25, at an appropriate distance from the cylinder shaft 31. By locating the first clamp 43 at an appropriate distance from the cylinder shaft 31, the movement of the hydraulic hose 39 can be absorbed. Also, the second clamp 60 can be located close to the cylinder shaft 31 without the need to locate the second clamp 60 away from the cylinder shaft 31 to ensure an extra length of the hydraulic hose 39 for the flexing. In this manner, the flexing of the hydraulic hose 39 caused when the boom 12 is swung up and down can be suppressed. As shown in FIG. 8, in this embodiment, the hydraulic hose 39 does not protrude from the cylinder tube 28 in the side view, even when it is at a position X1 where the boom cylinder 19 is most extended (raised) or at a position X2 where the boom cylinder 19 is most contracted (lowered). That is, the hydraulic hose 39 moves within the width of the cylinder tube 28 in a swingable range of the boom cylinder 19 around the cylinder shaft 31. In this manner, the hydraulic hose 39 can be prevented from contacting the working tools, boom 12, or other obstacles.

The first regulation portion 58*b* restricts the flexing of the hydraulic hose 39 so that the hydraulic hose 39 does not protrude in the distal direction in the machine body. In detail, a proximal end of the regulation portion 58*b* is located forward of a distal end of the sidewall 35, and can restrict the hydraulic hose 39 so that the hydraulic hose 39 does not widely protrude laterally outward from the swing bracket 10. In this manner, the hydraulic hose 39 can be prevented from hitting an obstacle to be damaged.

Also, when the hydraulic hose 39 waves in an S-shape in swinging the boom 12 downward, the hydraulic hose 39 may be bent at a small curvature to be damaged. The second regulation portion 58*c* restricts this waving of the hydraulic hose 39.

The present embodiment can be designed and modified in various ways. For example, the first hydraulic hose 39 and the second hydraulic hose 39 may be inserted through the same through hole 41. That is, at least one through hole 41 should be formed. In this case, the clamp structure 42 is disposed only on one of the left or right portions of the swing bracket 10. That is, the clamp structure 42 (first clamp 43) need only be disposed inside at least one of the first sidewall 35L and the second sidewall 35R.

The base portion 12*a* of the boom 12 may be formed in a bifurcated shape, and the boom pivotal support portion 22 may be sandwiched by the bifurcated base portion 12*a*. Also, each of the upper pivotal support base portion 36 and the lower pivotal support base portion 37 may be constituted of one wall portion, and a pivotal support bracket may be inserted between the upper pivotal support base portion 36 and the lower pivotal support base portion 37, and a single pin may be used to pivotally connect the upper pivotal support base portion 36 and the lower pivotal support base portion 37 to the pivotal support bracket 11. Also, the connecting portion 30 of the cylinder tube 28 may be formed in a bifurcated shape, and the cylinder pivotal support portion 23 may be sandwiched by the bifurcated connecting portion 30.

The working machine 1 according to the embodiment, includes the machine body 2, the support bracket (swing bracket 10) provided on the front portion of the machine body 2, the support bracket including the boom pivotal support portion 22 at the upper portion thereof, and the cylinder pivotal support portion 23 at the front lower portion thereof, the boom 12 pivotally supported by the boom pivotal support portion 22 via the boom shaft 25, the boom cylinder 19 pivotally supported at one end portion thereof by the cylinder pivotal support portion 23 and at the other end portion thereof by the boom 12, a telescopic action of the boom cylinder 19 causing the boom 12 to swing upward and downward, the hydraulic hose 39 extended through the support bracket from the rear of the support bracket to the front of the support bracket and connected to the boom cylinder 19, the first clamp 43 to retain the hydraulic hose 39 on the support bracket, and the second clamp 60 to retain the hydraulic hose 39 on the boom cylinder 19. The support bracket includes the through hole 41 through which the hydraulic hose 39 is passed in a fore-and-aft direction K1. The first clamp 43 is disposed rearward of the through hole 41 and forward of the rear end of the boom shaft 25.

According to this configuration, the movement of the hydraulic hose 39 caused when the boom 12 is swung up and down can be absorbed well, and the flexing of the hydraulic hose 39 can be suppressed.

Also, the boom cylinder 19 includes the cylinder tube 28 pivotally supported by the cylinder pivotal support portion 23, and the piston rod 29 capable of protruding and withdrawing from and into the cylinder tube 28, the piston rod 29 being pivotally connected to the boom 12. The second clamp 60 is attached to the cylinder tube 28. The hydraulic hose 39 moves within the width of the cylinder tube 28 in the swingable range of the boom cylinder 19 around the cylinder shaft 31.

According to this configuration, the hydraulic hose 39 can be prevented from contacting an obstacle to be damaged.

Also, the through hole 41 has proximal and distal ends in the machine body and the first clamp 43 is disposed rearward of the proximal end of the through hole. The clamp 43 is slanted forwardly in a distal direction in the machine body and forwardly upward.

According to this configuration, the hydraulic hoses 39 can be smoothly arranged from the first clamp 43 toward the boom cylinder 19 through the through hole 41.

Also, the working machine 1 includes the cylinder shaft 31 via which the boom cylinder 19 is pivotally supported by the cylinder pivotal support portion 23. The first clamp 43 is disposed at a position lower than the upper end of the cylinder shaft 31 and closer to the lower end of the through hole 41 than the vertically middle portion of the through hole 41.

According to this configuration, the hydraulic hoses 39 can be smoothly arranged from the first clamp 43 toward the boom cylinder 19.

Also, the working machine 1 further includes the clamp bracket 44 via which the first clamp 43 is attached to the support bracket (swing bracket 10). The support bracket includes the sidewall 35 including the boom support portion 22. The clamp bracket 44 is attached to an inside portion of the sidewall 35 by the fastener (bolt 51) provided onto the sidewall 35 from the outside of the sidewall 35.

According to this configuration, the hydraulic hoses 39 and the first clamp 43 assembled with the clamp bracket 44 can be attached from the outside of the support bracket, which allows the hydraulic hose 39 and the first clamp 43 to be easily attached. Also, the clamp bracket 44 can be removed from the outside of the support bracket, which provides easy maintenance.

Also, the sidewall 35 includes the first sidewall 35L and the second sidewall 35R opposed to each other with a space therebetween, and the front wall 40 connecting front portions of the first and second sidewalls 35L and 35R to each other. The cylinder pivotal support portion 23 is provided on the front wall 40. The through hole 41 is formed in the front wall 40 beside the cylinder pivotal support portion 23. The first clamp 43 is disposed on the inside portion of at least one of the first and second sidewalls 35L and 35R.

According to this configuration, the hydraulic hose 39 that is arranged from the rear of the support bracket to the front thereof passing through the support bracket can be supported on the inside of the sidewall 35.

Also, the working machine 1 includes the hose guide 56 attached to the support bracket (swing bracket 10) to guide the hydraulic hose 39. The hose guide 56 includes the first regulation portion 58*b* disposed forward of the through hole 41 and on the distal side of the hydraulic hose 39 in the machine body, and the second regulation portion 58*c* extended from the lower end of the first regulation portion

58*b* in the proximal direction in the machine body so as to be located below the hydraulic hose 39.

According to this configuration, the first regulation portion 58*b* can restrict the hydraulic hose 39 so that the hydraulic hose 39 does not protrude in the distal direction in the machine body, thereby preventing the hydraulic hose 39 from hitting an obstacle to be damaged. Also, the second regulation portion 58*c* can prevent the hydraulic hose 39 from being bent, in lowering the boom 12, at a small curvature to be damaged.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine, comprising:

a machine body;

a support bracket provided on a front portion of the machine body, the support bracket including a boom pivotal support portion at an upper portion thereof, and a cylinder pivotal support portion at a front lower portion thereof, a boom pivotally supported by the boom pivotal support portion via a boom shaft;

a boom cylinder pivotally supported at one end portion thereof by the cylinder pivotal support portion and at the other end portion thereof by the boom, a telescopic action of the boom cylinder causing the boom to swing upward and downward;

a hydraulic hose extended through the support bracket from the rear of the support bracket to the front of the support bracket and connected to the boom cylinder;

a first clamp to retain the hydraulic hose on the support bracket; and a second clamp to retain the hydraulic hose on the boom cylinder, wherein the support bracket includes a through hole through which the hydraulic hose is passed in a fore-and-aft direction, and the first clamp is disposed rearward of the through hole and forward of a rear end of the boom shaft.

2. The working machine according to claim 1, comprising:

the boom cylinder includes a cylinder tube pivotally supported by the cylinder pivotal support portion, and a piston rod capable of protruding and withdrawing from and into the cylinder tube, the piston rod being pivotally connected to the boom, the second clamp is attached to the cylinder tube, and the hydraulic hose moves within a width of the cylinder tube in a swingable range of the boom cylinder.

3. The working machine according to claim 1, wherein the through hole has proximal and distal ends in the machine body and the first clamp is disposed rearward of the proximal end of the through hole, and the clamp is slanted forwardly in a distal direction in the machine body and forwardly upward.

4. The working machine according to claim 1, further comprising:

a cylinder shaft via which the boom cylinder is pivotally supported by the cylinder pivotal support portion, wherein the first clamp is disposed at a position lower than an upper end of the cylinder shaft and closer to a lower end of the through hole than a vertically middle portion of the through hole.

5. The working machine according to claim 1, further comprising:

a clamp bracket via which the first clamp is attached to the support bracket, wherein the support bracket includes a sidewall including the boom support portion, and the clamp bracket is attached to an inside portion of the sidewall by a fastener provided onto the sidewall from the outside of the sidewall.

6. The working machine according to claim 5, wherein the sidewall includes a first sidewall and a second sidewall opposed to each other with a space therebetween, and a front wall connecting front portions of the first and second sidewalls to each other, the cylinder pivotal support portion is provided on the front wall, the through hole is formed in the front wall beside the cylinder pivotal support portion, and the first clamp is disposed on the inside portion of at least one of the first and second sidewalls.

7. The working machine according to claim 1, further comprising:

a hose guide attached to the support bracket to guide the hydraulic hose, wherein the hose guide includes a first regulation portion disposed forward of the through hole and on a distal side of the hydraulic hose in the machine body, and a second regulation portion extended from a lower end of the first regulation portion in a proximal direction in the machine body so as to be located below the hydraulic hose.

* * * * *